United States Patent [19]

Zoleski et al.

[11] 4,320,016

[45] Mar. 16, 1982

[54] CARBON DIOXIDE-BLOWN OVERBASED CALCIUM ALKYLPHENOLATE LUBRICATING COMPOSITIONS

[75] Inventors: Benjamin H. Zoleski, Beacon, N.Y.; Gayle P. Herbert, Port Neches, Tex.; Rodney L. Sung, Fishkill, N.Y.; Robert M. Scarberry, Fairfax, Va.

[73] Assignee: Texaco Inc., White Plains, N.Y.

[21] Appl. No.: 78,346

[22] Filed: Sep. 24, 1979

[51] Int. Cl.[3] ..... C10M 1/38

[52] U.S. Cl. ..... 252/42.7

[58] Field of Search ..... 252/42.7

[56] References Cited

U.S. PATENT DOCUMENTS

| | | | |
|---|---|---|---|
| 3,474,035 | 10/1969 | Dadura | 252/42.7 |
| 3,528,917 | 9/1970 | Dadura et al. | 252/42.7 |
| 3,549,534 | 12/1970 | Holstedt et al. | 252/42.7 |
| 3,706,632 | 12/1972 | Day et al. | 252/42.7 |
| 3,761,414 | 9/1973 | Haugen et al. | 252/42.7 |
| 3,969,235 | 7/1976 | Sung et al. | 252/42.7 |
| 4,104,180 | 8/1978 | Burnop | 252/42.7 X |
| 4,171,269 | 10/1979 | Sung et al. | 252/42.7 X |
| 4,171,270 | 10/1979 | Sung et al. | 252/42.7 |

*Primary Examiner*—Andrew Metz

*Attorney, Agent, or Firm*—Carl G. Ries; Robert A. Kulason; Henry W. Archer

[57] ABSTRACT

A lubricating oil composition containing a blend of sulfurized calcium alkylphenolate having an alkylphenol to calcium metal rate of about 1.0 to 1.4 and a Ca content of 0.5 to 12 wt. % prepared by: (1) reacting at a temperature between 250° and 410° F. an alkylphenol with calcium alkoxyalkoxide to form a first reaction mixture utilizing between about 45 and 90 wt. % of the stoichiometric amount required to convert the alkylphenol to calcium alkylphenolate: (2) contacting the reaction mixture with sulfur at a temperature between about 440° and 460° F. in the presence of between about 13 and 20 wt. % of a lubricating oil based on the step 2 second reaction mixture, (3) contacting the second reaction mixture with calcium alkoxyalkoxide at a temperature between about 400° and 425° F.; first and second additions totaling about 280 percent of the stoichiometric amount of calcium alkoxyalkoxide to form said calcium alkylphenolate; (4) hydrolyzing the blown mixture by steam sparging with at least 100% of the stoichiometric amount of steam required for complete hydrolysis of the calcium-2-methoxyethoxide to calcium hydroxide at a temperature ranging from 350° to 410° F., blowing the hydrolyzed mixture with about 20% of the stoichiometric amount of $CO_2$ required for partial carbonation to form a blend of 20% carbonate overbased sulfurized calcium alkylphenolate and 80% hydroxide overbased sulfurized calcium alkylphenolate and adding thereto at a temperature of 340° to 350° F. a diluent oil.

10 Claims, No Drawings

CARBON DIOXIDE-BLOWN OVERBASED CALCIUM ALKYLPHENOLATE LUBRICATING COMPOSITIONS

BACKGROUND OF INVENTION

The invention relates to fluid compositions specially designed for use between two relatively moving surfaces in contact therewith for reducing friction therebetween and preserving the surface. More specifically, the invention discloses improved diesel lubricant compositions which exhibit superior oxidative stability, corrosion control and excellent alkaline retention.

These compositions contain novel overbased calcium alkylphenolates. By the term "overbased" is meant, generally, that the ratio of the number of equivalents of calcium metal to the number of equivalents of alkylphenolate moiety is greater than 1.

PRIOR ART

Sulfurized overbased calcium alkylphenolate additives of particular utility are those described in U.S. Pat. Nos. 3,474,935 and 3,706,632. The term "overbased" in the present instance is further defined to mean that the ratio of the number of calcium moiety to the number of alkylphenolate moiety is about 1.4:1 that is, a calcium metal to alkylphenolate ratio of 1.4:1.

Considering the background of the present invention, it has been found that railway diesel engine oils having a high degree of alkalinity, that is, a TBN of at least 6, are particularly desirable in that they prevent corrosion by oil-soluble acids formed by oxidative deterioration at the high temperature existing under normal conditions of engine employment in proximity to the combustion chamber. The term "TBN" or nominal "TBN" as employed herein refers to "total base number" defined as the quantity of acid, expressed in terms of the equivalent number of milligrams of potassium hydroxide that is required to neutralize all basic constituents present in one gram of a given sample. The method of evaluation is described in ASTM Method D 664.

Over the past several years, railroad engine manufacturers have been required to modify their new engines as well as the older engines which were being overhauled to meet certain environmental criterion. The engine modifications caused lube oil drain periods to be reduced. Instead of the normal six-month drain periods with 6 TBN oils, the oil must now be drained at about 3 months. To extend the oil drain periods to their original 6 month interval the engine builders are now recommending higher TBN oils (about 10) but the 10 TBN oils are usually more expensive than 6 TBN oils. A typical 6 TBN product which does not meet the new "tight" engine requirements contains a calcium salt of a sulfurized alkylphenol, and $NO_2$-blown ethoxylated Indopol H-300 olefin $P_2S_5$ acid and a 2,5-dimercapto-1,3,4-thiadiazole in a mineral oil base mixture.

DESCRIPTION OF THE PRIOR ART

Coassigned, copending U.S. application Ser. No. 754,658 filed Dec. 27, 1976 now U.S. Pat. No. 4,171,269 describes a lubricating composition consisting of a 2:1 overbased calcium salt of a sulfurized alkylphenolate, an alkenylsuccinimide and a chlorinated hydrocarbon in a mineral oil base stock mixture which provides a 10 TBN product that outperforms the aforementioned 6 TBN composition and a commercial oil containing an additive package (Oronite 2918N) consisting of 50 percent oil, 21% of the calcium salt of sulfurized dodecylphenol; 12% carbonate overbased calcium petroleum sulfonates; 12 percent of polyisobutenylsuccinimide and 5 percent chlorinated paraffin, in oxidative stability, corrosion control and alkaline retention. It was necessary to use a chlorinated hydrocarbon in the above formulation to maintain the silver frictional characteristics of the oil.

DETAILED DESCRIPTION OF THE INVENTION

Specifically, the lubricating composition of the invention is prepared by a multistage procedure:

In the first stage there is heated to 250°-350° F. an alkylphenol of the formula:

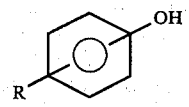

wherein R represents 1 or 2 monovalent saturated aliphatic radicals of from 5 to 50 carbons, preferably 10 to 15 carbons and where at least one ortho or para position remains unsubstituted, while sparging with an inert gas at a rate of 0.1 to 10 and preferably at 0.20 SCFH/gal. The sparged mass is reacted with a first addition of a calcium alkoxyalkoxide of the formula:

$$Ca(O—A—OR^1)_2$$

where A is a divalent saturated aliphatic hydrocarbon radical (alkanediyl) of 1 to 6 carbons and $R^1$ is alkyl of from 1 to 25 carbons at a temperature between about 200° and 425° F., preferably between about 320° and 425° F., utilizing a mole ratio of calcium alkoxyalkoxide to alkylphenol of between about 0.225 and 1, that is, an amount of calcium alkoxyalkoxide of between about 45 and 90 wt. % of stoichiometric to form a first reaction mixture while sparging with an inert gas at a rate of 0.1 to 10 and preferably 0.30 SFCH/gal. The reaction period is conducted until essentially all the alkoxyalkoxide has been reacted which is generally between about 1 and 8 hours.

As a second stage, the resultant first stage mixture is reacted with sulfur at a temperature between about 410° and 460° F., preferable about 450° F., in the presence of between about 13 and 20 wt. % of a hydrocarbon lubricating oil of an SUS viscosity of between about 50 and 2500 at 100° F. utilizing a mole ratio of sulfur to initial alkylphenol of between about 0.5:1 and 8:1, preferably between about 0.5:1 and 3, to form a second reaction mixture while advantageously passing through the second reaction mixture, an inert gas, at a rate of between 0.1 and 10, preferably 1.00 SCFH/gal., until no detectible $H_2S$ odor is found which is normally measured at less than 3 ppm $H_2S$ and a copper strip corrosion (ATSTM D-130) of a 2A maximum (3 hours—212° F.). The reaction time in the second stage is generally between 0.5 and 10 hours.

As a third stage, the gas blown second reaction mixture is contacted with a second amount of calcium alkoxyalkoxide at a temperature allowed to drop to between about 450° and 410° F., preferably 410° F., utilizing between about 0.45 and 1.12 moles of calcium alkoxyalkoxide per mole of original alkylphenol, the first and second additions of calcium alkoxyalkoxide totalling between about 100 and 300% of stoichiometric. The third stage reaction time is generally between about 0.5 and 8 hours.

In a fourth stage, the reaction mixture is stripped with an inert gas for about one hour at about 410° F. at a rate of 0.50 SCFH/gal.

In a fifth stage, the mixture is steam hydrolyzed with 100 percent of the amount of steam required for complete hydrolysis for between 1 and 2 hours while allowing the temperature of the reaction mass to drop to 350° F., then sparging with an inert gas is resumed.

In a sixth stage, the reaction mass is carbonated with 20 percent of the theoretical amount needed for partial carbonation at a rate of 0.5 SCFH for about two hours at between 300° and 400° F.

In a final stage, a diluent oil and a filter aid slurry are added to the reaction mass which is then filtered.

The hydrocarbon diluent oils employed in the preparation of the sulfurized calcium alkylphenolate also function to form a portion of the base oil in the final compositions containing the sulfurized alkylphenolate. Suitable base oils and diluent oils include a variety of hydrocarbon lubricating oils such as naphthenic base, paraffinic base and mixed naphthenic and paraffinic base oils having an SUS viscosity at 100° F. of between about 50 and 250, preferably between about 90 and 150. In formulating diesel lubricating oil compositions, the finished compositions desirably have an SUS viscosity between about 900 and 1100 at 100° F.

Under advantageous conditions in the first and third stages, the calcium alkoxyalkoxide reactant is introduced into the reaction system as a solution, if not already in the liquid form, to facilitate reaction contact. The solvent medium is usually the corresponding alkoxyalkanol (if liquid) of the alkoxyalkoxide component. The concentration of the calcium alkoxyalkoxide in the solvent medium is normally between about 20 and 60 wt. %. The solvent is advantageously removed as overhead during the early phase of each stage.

In the sulfurization stage, the sulfur is desirably introduced as a slurry in a hydrocarbon lubricating oil, such slurry most preferably having a sulfur content of about 13 to 20 wt. %. The lubricating oil, as in all stages, continues on and makes up a portion of the final concentrate product.

The first, second and third stages of the reaction are advantageously conducted in an inert gas atmosphere, e.g., employing inert gas blowing (0.1-10 SCFH/gal.). Further, agitation is normally employed in the first three stages of the procedure in order to facilitate ingredient contact.

The final product is filtered, if such is required, by standard means. The preferred filtration is accomplished by adding to the final mixture between about 0.01 and 1 wt. % diatomaceous earth and passing the material to be filtered through a press leaf filter precoated with diatomaceous earth at a temperature between about 200° and 300° F. and a pressure between about 5 and 1000 psig.

The formed sulfurized calcium alkylphenolate product contents in lubricating oil compositions contemplated herein range anywhere from 0.1 to 90 wt. %. The higher concentrations, e.g., between about 10 and 90 wt. % sometimes referred to in the art as concentrates are normally found in lubricant compositions resulting directly from the manufacture of the sulfurized calcium alkylphenolate ingredient in finished (dilute) lubricating oil compositions employed for engine use in desirably between about 0.1 and 7.5 wt. % with a calcium concentration of between about 0.06 and 0.5 wt. %, preferably about 0.1 and 0.4 wt. %. The concentrates are principally formed for storage and transport and are subsequently blended to finished oil compositions for engine use having a sulfurized calcium alkylphenolate of between about 0.1 and 10 wt. %.

In the finished lubricating oil compositions, other additives may be included such as supplementary dispersants, pour depressors, antioxidants, silver corrosion inhibitors, viscosity index improvers, oleagenous agents and antifoamant mixtures thereof. Exactly what other additives are included in the finished oil and the particular amounts therein will, of course, depend on the particular use the finished product is to be put to. One of the most suitable uses found for the overbased calcium alkylphenolate produced herein are lubricants for railway diesel engines. Examples of additives found in railway diesel engine oils in addition to the sulfurized calcium alkylphenolate are as follows:

One preferred supplementary detergent-dispersant, ethoxylated inorganic phosphorus acid free, steam hydrolyzed, polybutene-$P_2S_5$ reaction products further described in U.S. Pat. Nos. 3,272,744 and 3,087,956.

This supplementary detergent appears to cooperate with the overbased calcium alkylphenolate to enhance detergency and thermal stability and resistance to undesired oxidative decomposition. The ethoxylated product is present in the finished compositions of the invention in amounts between about 0.3 and 10 wt. % (oil free basis), preferably between about 0.8 and 4 wt. %, and in any case in sufficient amount to give a phosphorus content in the finished (dilute) compositions of between about 0.03 and 0.15 wt %, preferably between about 0.01 and 0.08 wt. %.

Another supplementary detergent dispersant employed as an alternative to the aforedescribed ethoxylated inorganic phosphorus acid free, steam hydrolyzed polybutene-$P_2S_5$ reaction product are the $C_{50}$–$C_{200}$ alkenyl succinimide derivatives of alkylene polyamines of the type described in U.S. Pat. Nos. 3,172,892 and 3,210,383. This alternative supplementary detergent, like the aforementioned polybutene-$P_2S_5$ derivative, appears to complement the subject sulfurized calcium alkylphenolate to enhance the detergency, thermal stability and resistance to undesired oxidative decomposition. The succinic anhydride derivative is present in the finished compositions of the invention on a neat basis of between about 1.0 and 10 wt. % and in sufficient amount to give a nitrogen content in the finished (dilute) composition of between about 0.01 and 0.12 wt. %, preferably between about 0.015 and 0.3 wt. %.

A still further specific additive which is advantageously included along with the supplementary detergent and antioxidant is the polymeric dimethyl silicone antifoamants. The silicone polymers are desirably employed in amounts of about 100 to 1000 ppm.

Specific examples of the alkylphenol reactants contemplated herein are 4-octylphenol, 4-t-octylphenol, 2-decylphenol, 2-dodecylphenol, 4-hexadecylphenol, 3,4-didodecylphenol, 2-nonylphenol, 4-tricontylphenol, 4-eicosylphenol and a mixture of decyl and dodecyl phenol ($C_{10}+C_{12}$ alkylphenol) and a mixture of 2 and 4 positioned monoalkyl and dialkylphenols. It is to be noted that the alkylphenols employed will normally be p-alkylphenols, however, 2,4-substituted alkylphenols may also be employed. The only restriction is an ortho or para position of the alkylphenol reactant is desirably available for sulfurization.

Examples of the calcium alkoxyalkoxide reactants contemplated herein are calcium 2-methoxyethoxide, calcium 2-methoxypropoxide, calcium 3-methoxybutoxide, calcium 2-ethoxyethoxide and calcium 4-dodecoxyhexoxide. Their corresponding alkoxyethanol diluents are 2-methoxyethanol, 2-methoxypropanol, 3-methoxybutanol, 2-ethoxyethanol and 4-dodecoxyhexanol.

The inert gas normally employed is nitrogen and, most preferably, nitrogen with a purity of at least about 99 wt %.

As heretofore stated, the sulfurized calcium alkylphenolates are in actuality a complex mixture of compounds. One representation is as follows:

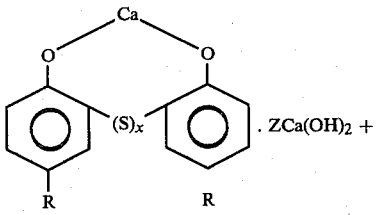

80 weight percent

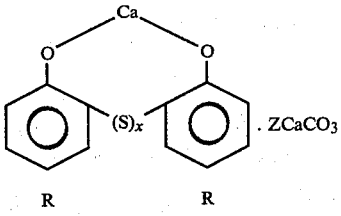

20 weight percent where R, is as heretofore defined, x is an integer from about 1 to 2, and Z is about 1 to 2. The foregoing formula are only set forth as a visual representation since sulfurized calcium alkylphenolate is in essence of complex mixture of many substances including mono and polysulfides, and therefore, the product can only be truly defined only in terms of process. In any case, the R group is believed to be primarily in the para position and the sulfur linked mainly in the ortho position. Further, there is probably also a significant amount of covalent character for the calcium-oxygen bond. It is to be noted that the calcium and sulfur contents of the sulfurized calcium alkylphenolate component are respectively between about 1 and 8 wt. % and 0.5 and 12 wt. %.

Specific examples of the ethoxylated derivative of the inorganic phosphorus acid free, steam hydrolyzed polybutene-$P_2S_5$ reaction product are ethoxylated steam hydrolyzed polyisobutene (1100 m.w.)-$P_2S_5$ reaction product, ethoxylated, steam hydrolyzed polybutene (1500 m.w.)$P_2S_5$ reaction product, ethoxylated, steam hydrolyzed polybutene (800 m.w.) —$P_2S_5$ reaction product, ethoxylated, steam hydrolyzed polyisobutene (200 m.w.)—$P_2S_5$ reaction product where the ethylene oxide component and the reaction product component are present in a mole ratio of 1.1.

In regard to the aforementioned alternative supplementary succinimide, this succinimide may be characterized by the formula:

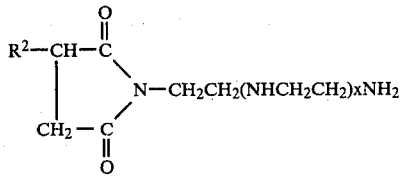

where $R_2$ is alkenyl of from 50 to 200 carbons, x is an integer of from 0 to 10, particularly suitable examples are where $R_2$ is polyisobutylene of a molecular weight of about 1000 to 1500 and x is 4 and where R is polyisobutylene of about 1000 to 1500 m.w. and x is 5 and mixtures thereof. They are described in U.S. Pat. Nos. 3,172,892 and 3,210,383.

The following examples further illustrate the invention but are not to be construed as limitations thereof.

EXAMPLE I

This example illustrates the preparation of the product of the invention. To a reactor fitted with a variable speed stirrer and means for heating an overhead receiver and a sparger there was charged 10,153 pounds (1300 gallons) $C_{10}$–$C_{12}$ alkylphenol (m.w. 280). It was heated from ambient temperature to 250° C. over a period of two hours while passing nitrogen therethrough at a rate of 0.20 s.c.f.h/gal. of mixture. At this point 7,808 pounds (875 gls.) of calcium 2-methoxyethoxide (having a density of 8.92 lb/gal. and 7:85 wt. % Ca basis 220 TBN) were added with agitation and the temperature was raised to 410° F. over a period of an additional 6 hours while continuing to strip with nitrogen at a rate of 0.30 s.c.f.h/gal. and collecting condensate in overbased receiver. At the end of the 6 hour period, the nitrogen flow was interrupted and there was charged to the system a slurry containing 1,350 pounds of sulfur and 2058 pounds of paraffinic base lubricating oil having an SUS viscosity at 100° F. of about 100. The temperature was raised to 450° F. over a period of one hour and maintained for four hours while stripping with nitrogen at a rate of 1.00 s.c.f.h/gal. After the end of this four hour period, nitrogen sparging was interupted and all condensate was collected in the overhead receiver. Then over a 3 hour period, a second addition of the same calcium reagent was made consisting of 15,616 pounds (1,750 gals.) while allowing the system temperature to drop to 410° F. The temperature was maintained at 410° F. while stripping with nitrogen at a rate of 0.50 s.c.f.h/gal. for one hour. After one hour of nitrogen stripping, the nitrogen flow was stopped/the overhead was drained and added to the condensate collected during the second calcium reagent charge. Steam (1,001 pounds, 120 gals) was charged at the rate of 1.33 g/min. through the sparger for 1.5 hours, using deionized water in steam generator. The reactor temperature was allowed to drop from 410° F. to 350° F. during steaming. When steaming was completed, nitrogen flow through the sparger resumed for one hour at the rate of 0.50 s.c.f.h./gals. Next 491 pounds of carbon dioxide were charged over a 2-hour period through the sparger at a rate of 0.50 s.c.f.h. After $CO_2$ blowing, diluent oil (12,863 pounds, 1750 gals) and a filter aid slurry (300 pounds) were charged and let mix for 0.5 hours. The reactor temperature was maintained at 350° F. and filtering was carried out using a 2 ft. square sparkler horizontal plate filter. The reactor was pumped out using 12,863 pound (1,750 gals.) of high finish lubricating oil. The filtered product amounted to 30,441 pounds (3,650 gals.). The loss free material balance for this example is tabulated in Table I below.

TABLE I

| Charge | Pounds | Gallons | Lb./Gal(1) | MW |
|---|---|---|---|---|
| Alkylphenol | 10153 | 1300 | 7.81 | 280 |
| 1st Ca Reagent(2) | 7808 | 875 | 8.92 | 510(a) |
| Sulfur | 1350 | — | — | 32 |
| 100 E Pale Stock HF | 2058 | 280 | 7.35 | — |
| 2nd Ca Reagent(2) | 15616 | 1750 | 8.92 | 510(a) |
| Steam | 1001 | 120 | 8.34 | 18 |
| $CO_2$ | 491 | — | — | — |
| Filter Aid(3) | 300 | — | — | — |
| Diluent Oil(4) | 12863 | 1750 | 7.35 | — |
| Total | 51640 | | | |
| Recovery | | | | |
| Filtered Product | 30441 | 3650 | 8.34 | — |
| Recoverable MOE(5,7) | 18901 | 2342 | 8.07 | — |
| Sour MOE(6) | 787 | 102 | 7.70 | — |
| $H_2S$ | 711 | — | — | 34 |
| $CO_2$ | 255 | — | — | 44 |
| Filter Cake | 545 | — | — | — |
| Total | 51640 | | | |

(a)Basis Ca content.
(1)Density at 60° F.
(2)Basis 220 TBN (7.85 wt. % Ca).
(3)Added in filter feed tank.
(4)Added during pumpout to filter feed tank.
(5)MOE collected before sulfur charge and after 2nd Calcium Reagent charge.
(6)MOE collected after sulfur charge and before 2nd Calcium Reagent charge.
(7)MOE is methyl cellosolve.

The performance of diesel oils containing the additive of the invention was compared with that of several commercially available oils by the following tests.

1. The Union Pacific Oxidation Test (UPOT) is used by railroads to judge the acceptability of an oil for use in their equipment. The test measures corrosion (50 mg. max. limit) and oxidative stability (20% max. viscosity increase at 100° F.) as well as other used oil parameters (pH-which is used by some railroads to judge the oil drain interval—below 5, drain; above, 5, satisfactory; TBN can be used as a measure of alkaline retention). The test method involves bubbling 5 liters of oxygen per hour through 300 mls. of test oil composition at 285° F. in which there is immersed a 1×3×0.06 inch steel backed copper-lead test specimen cut from bearing stock. The viscosity of the test oil is measured before and after the 144 hour test period. An increase in the viscosity of the test oils reflects oxidative stability. In addition, the test specimen is weighed before and after the test period and the greater the weight loss of test specimen the greater the corrosion deterioration of the test formulation. Further, the larger the amount of copper, iron and lead moieties found in the oil after test the greater the oxidative deterioration thereof.

2. In the Santa Fe Lube Oil Oxidation Test (SFLOOT) the oil sample and a steel backed copper-lead bearing strip are placed in a glass tube and this assemblage is placed in a bath at 285° F. During the test, oxygen is bubbled through the oil at a rate of 5 liters per hour. A 50 ml oil sample is taken from the tube each 24 hours and the quantity of test oil is replenished by adding 50 ml of new oil. After 72 hours (test termination) bearing weight loss, viscosity, neut. no. and solvent insolubles are obtained.

3. In the SOD lead corrosion test which measures the corrosiveness of lubricating oils on lead in the presence of copper, panels of lead and copper are rotated in the test lubricant under specific conditions and the degree of corrosion is determined from the change in weight of the lead panel.

4. In the Alco lead shot corrosion test, the corrosive effect of railway diesel crankcase oil on lead is determined by heating in an oven at 225° F. for 40 hours a sample of oil containing a specified amount of granular lead. After this time the loss in weight of the lead is determined.

5. The General Electric Co. uses the G.E. Oxidation Test to evaluate the performance of an oil for use in their equipment. In this test an oil is catalyzed using bronze and steel metal specimens at 330° F. for 48 hours. The viscosity of the 48 hour oil sample is determined.

6. The Electro-Motor Division (EMD) of General Motors employs their EMD Silver Corrosion Test to approve oils for use in their engines. In this test the oil is evaluated at 325° F. for 72 hours. The critical areas of evaluation are silver corrosion, oil thickening, pH decrease, TAN increase and TBN depletion.

At the end of Table III, the L-38 Test is based on Federal Test Method Std. No. 791*a*, Method 3405.1.

This test provides a method for studying the oxidation and cooper-lead bearing corrosion characteristics of crankcase oils. Performance of the test oil is judged by a visual examinaton of the engine for deposits, by the weight loss of the copper-lead test bearing, and by comparison of the inspection data on samples of used oil taken at periodic intervals with the inspection data on the new oil. A single-cylinder Labeco CLR Oil Test Engine equipped with copper-lead connecting rod bearing is used for L-38 testing. Major test stand components include a gas meter for measuring off-gas rates and an external electrical oil heater to control oil temperature.

In carrying out this test, copper-lead bearing are weighed at the end of the 40 hour test. Engine components are visually rated and used oil analyses are obtained.

The Caterpillar 1-G2 Test is described in the FTM-341 amended according to U.S. Army Engine Oil Reviewing Committee Information Letter No. 80, issued data February 15, 1977.

Its purpose is to evaluate the effect of a lubricant on ring sticking, wear, and the accumulation of deposits during a 240 hour endurance run.

Test Equipment is a 1Y-73 Caterpillar single cylinder test engine equipped with a 1Y-493 piston and 1Y-491 ring set and necessary operating controls.

The performance of the test lubricant is judged by examination of the power section for ring sticking, piston deposits and ring, piston and liner wear. Satisfactory performance requires 80% maximum top groove filling and a maximum of 300 weighted total demerits (WTD). The WTD is calculated by determining the deposit factors by measuring the thickness of carbon deposits and the lacquer deposit color intensity multiplied by given location factors.

As shown in Table II the oil of the invention shows a satisfactory UPOT weight loss value of 2 mgs. (50 mg. max. limit) while the Oronite 218A version ("A") fails with a value of 691 mgs. and the Amoco (B,C) versions also fail with value of 642 and 484 mgs respectively. The UPOT viscosity increase value for the experimental oil is acceptable at 7% (20% max. limit) while the C, A and B versions fail with value of 422, 156 and 149, respectively. The present oil also shows a 19.4% alkaline retention value while C, A and B show lower values of 1.3, 3.3 and 1%, repectively.

This same effect in UPOT performance can be observed by comparing the present oil with the three competitive 10 TBN oils in Table III. It outperforms "D", E and F in UPOT corrosion control and oxidative stability and is equivalent to D in alkaline retention while being superior to the other oils in this category.

In the G.E. test the composition of the invention is slightly poorer (9.3%) than D (6.6%) and E (8.7%) but within the recommended limit of 10% max. The present invention outperforms F which gives a failing value of 11.2%.

In the EMD test all the oils considered were equivalent in regard to silver and copper corrosion but the oil of the invention is superior to the competitive oils in oxidative stability at both 285%F. and 325° F. Its alkaline retention at the 285%F. and the test conditions became more severe, its alkaline retention was much better than the three oils. Overall, the present oil, on a demerit basis, at both temperatures, is better than the other three oils.

The silver and bronze frictional characteristics of the present oil are satisfactory and equivalent to the other three oils and the laboratory engine performance of all the oils is equivalent.

A typical oil composition according to this invention is shown in Table III. Evidently this oil can be blended to have an original Total Base Number TBN value of 0 through 15, but preferably is blended to have an original TBN of 10. The preferred oil containing the new overbased calcium sulfurized phenolate shows improvements in corrosion control, oxidative stability and alkaline retention over competitive 10 TBN oils and is superior in these same areas when compared to competitive calcium overbased sulfurized phenolates. This superiority is particularly noteworthy relative to composition F which contains a railway diesel oil additive that is commercially available and that imparts anticorrosion, antioxidant, detergency and dispersancy qualities to the crankcase oil.

Table IV compares the performance in the UPOT test of various compositions containing various detergents and dispersants. Oil H (containing the material of this invention) outperforms the competitive oils as regards weight loss. More significantly, the data in Table IV show that the formulations containing the additive of this invention do not need the Amoco 150 additive to pass the UPOT test.

TABLE II

| Identification | Invention | Prior Art "A" | Prior Art "B" | Prior Art "C" | Limits |
|---|---|---|---|---|---|
| Composition, Wt. % | | | | | |
| Oil (AP1 Gr. 20.5–23.5) | 3.00 | 3.00 | — | — | |
| SNO-20[1] | 5.00 | 5.00 | 5.00 | 5.00 | |
| SNO-40[2] | 47.70 | 46.89 | 48.75 | 51.80 | |
| 75/80 Pale Oil[2,4] | 37.00 | 37.00 | 37.00 | 37.00 | |
| Present Additive | 4.85 | — | — | — | |
| Oronite 218A[3] | — | 5.66 | — | — | |
| 4 4 | — | — | 6.40 | — | |
| 4 4 | — | — | — | 3.35 | |
| 5 | 2.40 | 2.40 | 2.80 | 2.80 | |
| 6 | 0.05 | 0.05 | 0.05 | 0.05 | |
| 7 | 150 | 150 | 150 | 150 | |
| Union Pacific Oxidation Test | | | | | |
| Weight Loss, mg. | 2 | 691 | 642 | 484 | 50 Max. |
| Viscosity Increase, % | 7 | 422 | 156 | 149 | 20 Max. |
| Alkaline Retention, % | 19.4 | 1.3 | 3.3 | 1 | — |

[1]Solvent neutral oil.
[2]Solvent neutral oil.
[2,4]Sp. Gr. 0.922–0.941; AP1 Gr. 14.0–22.0; SUS 130° F. 425; pour 10° C. max.
[3]$CO_2$ neutralized sulfurized overbased calcuim phenates Ca-5.25 wt. %; having a TBN 147.
[4]Boron-containing ashless dispersant.
[5]50% polybutenyl (mw 1300) succinimide of tetraethylene pentamine in mineral oil having a gravity (AP1) of 25–29: Vis. SUS at 100° F. of 100 to 104 and a pour less than 25° F.
[6]Methacrylate pour depressant.
[7]Silicone antifoamant.

TABLE III

| Composition, Vol. % | Invention | D | E | F | |
|---|---|---|---|---|---|
| AP1 Grav. (20.5–23.5) | | | | | |
| Oil | — | — | 3.00 | — | |
| SNO-20[1] | 5.15 | 8.50 | — | 17.00 | |
| SNO-40[2] | 51.20 | 42.50 | 57.80 | 33.00 | |
| Oil[2,4] | 36.20 | 35.50 | 29.96 | 39.00 | |
| Additive of Invention[A] | 4.55 | — | — | — | |
| Dispersant[B] | 2.80 | — | — | — | |
| Pour Depressent | 0.05 | — | — | — | |
| Chlorowax 500C | 0.05 | — | — | — | |
| Oronite 2717A | — | 13.50 | — | — | |
| Oronite 2918N[9] | — | — | 9.2 | — | |
| RDO Additive Package | — | — | — | 11.00 | |
| Amoco 6555 | | | | | |
| Antifoam Agent, ppm | 150 | — | — | — | |
| Tests | | | | | Railroad and Engine Builder's Limits |
| Gravity, °AP1 | 23.6 | 23.4 | 23.4 | 23.4 | 22.5–24.5 |
| Flash, COC, °F. | 495 | 485 | 490 | 475 | 450 Min. |

TABLE III-continued

| | | | | | |
|---|---|---|---|---|---|
| Viscosity, SUS at | | | | | |
| 100° F. | 993 | 1022 | 990 | 974 | 950–1050 |
| 210° F. | 78.7 | 79.4 | 79.4 | 79.3 | 76.5–81.0 |
| Viscosity Index | 73 | 70 | 74 | 75 | 76.5–81.0 |
| Pour, °F. | −10 | −5 | 0 | −20 | 10 Max. |
| Color, ASTM, Dil | 3.0 | 4.0 | 4.0 | 5.5 | |
| TAN (Total Acid No.) | 0 | 0.9 | 0.6 | 0.5 | |
| Carbon Residue, % | 0.93 | 1.2 | — | 0.91 | |
| Sulfated Ash, % | 0.95 | 1.1 | 1.2 | 0.88 | |
| Calcium, % | 0.30 | 0.32 | 0.35 | 0.29 | |
| Nitrogen, % | 0.05 | 0.09 | 0.08 | 0.09 | |
| Sulfur, % | 0.44 | 0.57 | 0.58 | 0.51 | |
| | | | | | Limits |
| Barium, ppm | 4 | 5 | — | — | 20 Max. |
| Sodium, ppm | 3 | 29 | — | — | 20 Max. |
| Silicon, ppm | 10 | 5 | — | — | 10 Max. |
| Zinc, ppm | 1 | 5 | 5 | 1 | 10 Max. |
| Foam, Seq. II, ml 10 Min. after blowing | 0 | 0 | 0 | 0 | 25 Max. |
| Copper Strip Corrn. | 1a | 1b | 1a | 1a | 1b Max. |
| Silver Disk Friction Test | Excellent | Excellent | Excellent | Excellent | Exc-Min. |
| Bronze Disk Friction Test | Excellent | Excellent | Excellent | Excellent | Exc-Min. |
| OXIDATIONS/CORROSION TESTS | | | | | |
| Alco Lead Corrn, Weight Change, mgs. | +2.8 | +0.41 | +0.2 | −3.1 | −10 Max. |
| SOD Lead Corrn, mg/in.$^2$ | −1.50 | −0.30 | −0.61 | −0.50 | |
| Lead Strip Corrn, g., dry | 0 | 0 | 0 | −0.0002 | |
| Lead Strip Corrn, g., wet | +0.0002 | −0.0444 | −0.0074 | +0.0004 | |
| G.E. Oxidation Test % Viscosity Increase | 9.3 | 6.6 | 8.7 | 11.2 | 10 Max. |
| SFLOOT | | | | | |
| Weight Loss, Mg | 2 | 1 | 132 | 5 | 50 Max. |
| pH | 9.2 | 9.5 | 6.0 | — | |
| TAN | 1.6 | 2.2 | 4.0 | 1.7 | |
| TBN | 2.2 | 2.3 | 1.6 | 2.9 | |
| SAN | 0 | 0 | 0 | 0 | |
| Pentane Insolubles, % | 0.01 | 0.02 | 0.05 | 0.01 | |
| Viscosity Increase, % | 7.0 | 7.2 | 33.0 | 8.3 | 15 Max. |
| Cu, ppm | 0 | 4 | 6 | 0 | |
| Pb, ppm | 0 | 0 | 490 | 0 | |
| | Invention | D | E | F | Limits |
| UPOT | | | | | |
| Weight Loss, mg. | 14 | 45 | 508 | 162 | 50 Max. |
| pH | 8.1 | 7.1 | 3.6 | 6.8 | |
| TAN | 1.9 | 4.9 | 17.6 | 3.2 | |
| TBN | 1.5 | 1.6 | 0 | 0.9 | |
| SAM | 0 | 0 | 0.4 | 0 | |
| Pentane Insolubles, % | 0.01 | 0 | 8.6 | 0.02 | |
| Alkaline Retention, % | 15.3 | 15.2 | 4.0 | 0 | |
| Viscosity Increase, % | 17.2 | 16.5 | 281 | 31.7 | 20 Max. |
| Cu, ppm | 0 | 0 | 81 | 0 | |
| Fe, ppm | 0 | 0 | 0 | 0 | |
| Pb, ppm | 30 | 140 | 600 | 470 | |
| EMD Silver Corrosion Test at 285° F. | | | | | |
| Ag - Wt Change, mg | −0.2 | +5 | −0.3 | −0.1 | |
| Cu - Wt Change, mg | −0.7 | +1.5 | −1.0 | −1.5 | |
| pH | 9.5 | 8.6 | 8.2 | 9.0 | |
| TAN | 0.1 | 1.9 | 1.2 | 0.7 | |
| TBN | 5.9 | 5.0 | 4.0 | 5.8 | |
| Pentane Insolubles, % | 0.01 | 0.01 | 0.01 | 0 | |
| Viscosity Increase, % | 6.3 | 8.8 | 6 | 7.3 | |
| Demerits* | 17 | 34 | 23 | 23 | |
| EMD Silver Corrosion Test at 325° F. | | | | | |
| Ag - Wt Change, mg | +0.6 ck +0.3 | +0.2 | 0 | +0.1 | |
| Cu - Wt Change, mg | −0.5 ck −0.4 | −0.2 | −0.2 | −2.5 | |
| pH | 9.1 ck 8.8 | 7.6 | 6.7 | 8.8 | |
| TAN | 0.4 ck 0.5 | 2.4 | 2.1 | 0.7 | |
| TBN | 5.4 ck 5.1 | 2.3 | 1.9 | 4.6 | |
| Pentane Insolubles, % | 0.02 ck 0.01 | 0.01 | 0 | 0.01 | |
| Viscosity Increase, % | 15.6 ck 11.9 | 29 | 36 | 15.6 | |
| Demerits* | 27 ck 29 | 64 | 57 | 34 | |

TABLE III-continued

| Identification | Laboratory Engine Tests Invention | D | E | F | Limits |
|---|---|---|---|---|---|
| L-38 Test | | | | | |
| BWL, mgs | 40.4 | 30.7 | 32.0 | 30.3 | 50 Max. |
| Cat. 1-G (240 Hrs.) | | | | | |
| TGF, % | 10 ck 27 | 19 | 5 | 58 | |
| WTD | 159 ck 66 | 105 | 161 | 334 | |

(Footnotes As In Table I)
[A]Provides a minimum of 0.30% Ca.
[B]Provides a minimum of 0.03% N.
[7]Chlorinated Paraffin
[8]Railway diesel additive package containing calcium petroleum sulfonates and alkylphenates
[9]Railway diesel additive package containing carbonate overbased calcium petroleum sulfonates, sulfurized calcium alkylphenolate, dispersant and inhibitors.
*at 285° F. - 0–15 demerits = excellent
15–30 demerits = good
30 demertis = unsatisfactory
at 325° F. - 0–30 demerits = excellent
30–60 demerits = good
60 demerits = unsatisfactory

TABLE IV

| Oil | Deter-gent | Dis-persant | Corrosion Inhibitor | TBN | UPOT (1) Wt. Loss, Mg. | % Viscosity Increase |
|---|---|---|---|---|---|---|
| G | (2) | (3) | (4) | 10 | 48 | 12 |
| H | Inven-tion | (3) | None | 10 | 8 | 14 |

(1) Test limits are 50 mg. max. weight loss and 20% max. viscosity increase.
(2) U.S. Pat. No. 3,969,235 detergent.
(3) Succinimide dispersant.
(4) 2,5-bis (octyldithio) thiadiazole.

The present invention may be embodied in other specific forms without departing from the spirit or essential attributes thereof and, accordingly, reference should be made to the appended claims, rather than to the foregoing specification as indicating the scope of the invention.

We claim:

1. A lubricating oil composition comprising a hydrocarbon oil of lubricating viscosity containing a blend of between about 0.1 and 90 wt. percent of sulfurized calcium alkylphenolates having an alkylphenol to calcium metal ratio of about 1 to 1.4, a calcium content between about 0.5 and 12 wt. %, wherein said blend is produced by the steps of:

(1) contacting an alkylphenol of the formula:

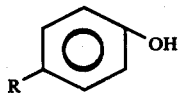

where R is alkyl of from 5 to 50 carbons with a first addition of calcium alkoxyalkoxide of the formula:

$Ca(O\text{-}A\text{-}OR')_2$ where A is alkanediyl of from 1 to 6 carbons and R' is alkyl of from 1 to 25 carbons at a first temperature between about 250° and 410° utilizing a mole ratio of calcium alkoxyalkoxide to said alkylphenol of between about 0.225 and 1.

(2) contacting the resultant mixture with sulfur in the presence of a hydrocarbon lubricating oil at a second temperature between about 440° and 460° F. utilizing a mole ratio of sulfur to initial alkylphenol of between about 0.5:1 and 8:1, said hydrocarbon oil in said second step constituting between about 13 and 20 wt. % of said reaction mixture;

(3) contacting the mixture with a second addition of calcium alkoxyalkoxide at a temperature of between 400° and 425° F. in a mole ratio of calcium alkoxyalkoxide to initial alkylphenol of between about 0.45:1 and 0.9:1 in sufficient amount so that the total calcium alkoxyalkoxide employed in the first and third steps will total a mole ratio of calcium alkoxyalkoxide to initial alkylphenol of between about 1:1 and 1.2:1; said first and second addition totaling between about 130 and 300% of the stoichiometric amount of calcium alkoxyalkoxide to form said calcium alkylphenolate, said steps 1, 2 and 3 being conducted while sparging their respective reaction mixtures with an inert gas at a rate of between about 0.1 and 10 SCFH per gallon;

(4) hydrolyzing the blown mixture by steam sparging with at least 100% of the stoichiometric amount of steam required for complete hydrolysis of the calcium alkoxyalkoxide to calcium hydroxide at a temperature ranging from 350° to 410° F.; and thereafter, (5) blowing the hydrolyzed mixture with about 20% of the stoichiometric amount of $CO_2$ at a gas rate of between about 0.1 and 10 SCFH/gallon required for partial carbonation thereby forming a blend of about 20% carbonate overbased sulfurized calcium alkylphenolate and about 80% hydroxide overbased sulfurized calcium alkylphenolate; said blend being present in said oil at a concentration sufficient to give said composition an alkalinity, expressed as total base number, of at least 10.

2. A lubricating oil composition in accordance with claim 1 wherein said inert gas is nitrogen.

3. A lubricating oil composition in accordance with claim 1 in concentrate form containing between about 10 and 90 wt. % of said sulfurized calcium alkylphenolate.

4. A lubricating oil composition in accordance with claim 1 containing between about 0.1 and 10 wt. % said sulfurized calcium alkylphenolate, and between about 1 and 10 wt. % of a supplementary dispersant selected from the group consisting of (1) ethoxylated inorganic phosphorus acid free, steam hydrolyzed polybutene (800–2500 m.w.)-$P_2S_5$ reaction product, said ethylene oxide moiety being present in respect to said hydrolyzed polybutene-$P_2S_5$ reaction product in a mole ratio of about 1:1 and polybutene-$P_2S_5$ component being present in a mole ratio to one another of between about 1:1, (2) and an alkenyl succinic anhydride derivative of alkylene polyamine characterized by the formula:

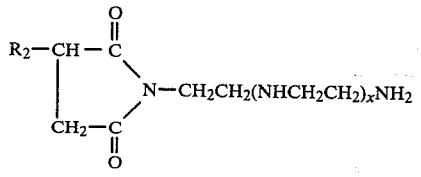

where $R_2$ is alkenyl of from 50 to 200 carbons, x is an integer of from 0 to 10.

5. A composition in accordance with claim 4 wherein said supplementary dispersant is said ethoxylated derivative and said polybutene is of a molecular weight of about 1200.

6. A composition in accordance with claim 5 wherein said supplementary dispersant is a polybutene succinic anhydride derivative of tetraethylene pentamine, wherein said butene was a molecular weight of about 1200.

7. The lubricating oil composition of claim 1, wherein said sulfur is introduced as a slurry in a hydrocarbon lubricating oil containing from about 13 to about 20 weight percent of sulfur.

8. A composition according to claim 1, wherein said alkylphenol is 4-dodecyl phenol and said alkoxide is calcium 2-methoxyethoxide dissolved in methanol in an amount ranging from 20 to 60 weight percent.

9. A composition according to claim 1 also containing a chloroparaffin.

10. The composition of claim 1, wherein said sulfurized calcium alkylphenolate is represented by the formulas:

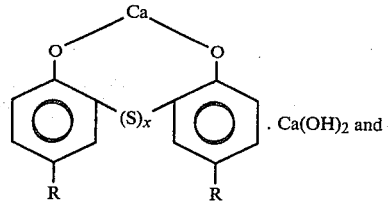

. $Ca(OH)_2$ and

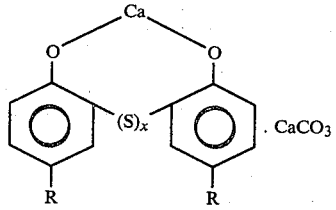

. $CaCO_3$ wherein R is alkyl having from 5 to 50 carbons and x is 1 or 2; said hydroxide overbased material comprising about 80 percent by weight and said carbonate overbased material comprising about 20 percent by weight of said alkylphenolate.

* * * * *